US005713250A

United States Patent [19]

Hendricks et al.

[11] Patent Number: 5,713,250

[45] Date of Patent: Feb. 3, 1998

[54] AUTOMATIC FASTENING TOOL AND METHOD THEREFOR

[75] Inventors: Daniel Albert Hendricks, Bothell; Arlen Ray Pumphrey, Arlington; Robert Stephen Schempp, Bothell, all of Wash.

[73] Assignee: The Boeing Company, Seattle, Wash.

[21] Appl. No.: 721,388

[22] Filed: Sep. 26, 1996

[51] Int. Cl.[6] ..... B25B 21/00

[52] U.S. Cl. ..... 81/54; 81/55; 173/2; 227/2

[58] Field of Search ..... 81/54, 55, 56, 81/57, 13; 364/130; 173/2, 11; 227/2, 3

[56] References Cited

U.S. PATENT DOCUMENTS

| | | | |
|---|---|---|---|
| 4,450,727 | 5/1984 | Reinholm et al. | 73/862 |
| 4,685,050 | 8/1987 | Polzer et al. | 364/152 |
| 4,815,190 | 3/1989 | Haba, Jr. et al. | 29/430 |
| 4,869,136 | 9/1989 | Easter et al. | 81/55 |
| 4,894,908 | 1/1990 | Haba, Jr. et al. | 29/711 |
| 5,014,794 | 5/1991 | Hansson | 173/2 |
| 5,224,032 | 6/1993 | Wörn et al. | 364/167 |
| 5,229,931 | 7/1993 | Takeshima et al. | 364/133 |

FOREIGN PATENT DOCUMENTS

| | | | |
|---|---|---|---|
| 11928 | 9/1984 | European Pat. Off. | 81/54 |
| 406099362 | 4/1994 | Japan | 81/54 |
| 1265032 | 10/1986 | U.S.S.R. | 81/54 |

*Primary Examiner*—James G. Smith
*Assistant Examiner*—Joni B. Danganan
*Attorney, Agent, or Firm*—Robert H. Sproule

[57] ABSTRACT

Apparatus for assembling fasteners includes a fastening wrench operated by a first operator and having interchangeable sockets of different sizes for engaging nuts of different sizes. The nuts are required to be tightened to different torque values on their respective bolts. When the first operator removes a socket from a socket tray in preparation for attaching the socket to the fastening wrench, a signal is sent to a controller which determines the torque value associated with that socket size. When the fastening wrench reaches the specified torque value during the tightening operation, the controller automatically shuts the fastening wrench off. The apparatus also includes a second wrench, operated by a second operator, for engaging the heads of the bolts to prevent them from turning during the tightening process. During the tightening process the second operator may not be in communication with the first operator. The second wrench includes a safety switch which when not depressed by the second operator, prevents the fastening wrench from operating for the protection of the second operator.

10 Claims, 9 Drawing Sheets

54
46
49
56
30
42
62
64
20
50
48
60
58
36
34

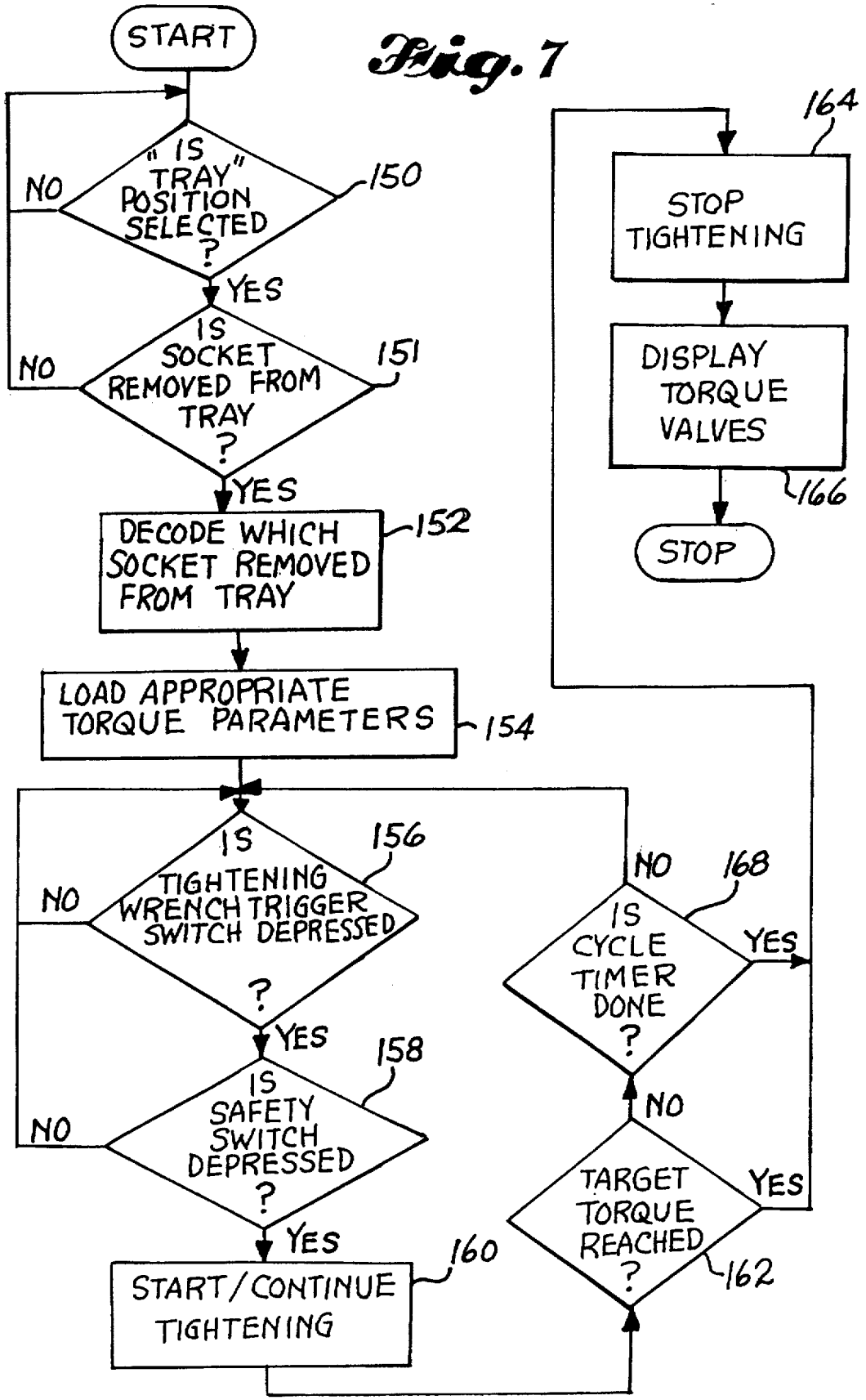
Fig. 7
START
IS "TRAY" POSITION SELECTED ?
150
NO
YES
IS SOCKET REMOVED FROM TRAY ?
151
NO
YES
DECODE WHICH SOCKET REMOVED FROM TRAY
152
LOAD APPROPRIATE TORQUE PARAMETERS
154
IS TIGHTENING WRENCH TRIGGER SWITCH DEPRESSED ?
156
NO
YES
IS SAFETY SWITCH DEPRESSED ?
158
NO
YES
START/CONTINUE TIGHTENING
160
IS CYCLE TIMER DONE ?
168
NO
YES
TARGET TORQUE REACHED ?
162
NO
YES
STOP TIGHTENING
164
DISPLAY TORQUE VALVES
166
STOP

AUTOMATIC FASTENING TOOL AND METHOD THEREFOR

TECHNICAL FIELD

The present invention relates to apparatus and methods for automatically tightening fasteners which join two parts together, and more particularly to apparatus and methods for automatically tightening threaded fasteners which join the wings to the body of a commercial airplane.

BACKGROUND OF THE INVENTION

During the fabrication of large commercial airplanes, the wings of the airplane are constructed separately from the fuselage center body section of the airplane. At a certain point in the assembly process, it is necessary to join the wings to the airplane body. This is accomplished by hoisting the wings into position where they are joined to a stub portion of the center body section by large number of nut and bolt fasteners.

In order to describe this in more detail, reference is made to FIG. 1 where there is shown an inboard portion of a port wing box 20 and an inboard portion of a starboard wing box 22 mounted to a stub indicated at 24 of an airplane center body section having a cabin skin portion 28. The wing stub 24 is formed by a port and starboard upper double plus-chords 30, 32 which are joined by vertical flanges 34, 36 to port and starboard lower single plus-chords 38, 40. The upper double plus-chords 30, 32 support there between a number of panels 42 upon which are mounted beams 44 for supporting the floor (not shown) of the passenger cabin 28; and the lower single plus-chords support a number of panels 45 there between which form the bottom of a center fuel tank.

As shown in FIG. 2, the port upper double plus-chord 30 includes upper and lower leftward extending parallel flanges 46, 48 which form a channel 49 for receiving therein a number of paddle fittings 50 (only one of which is shown) which in turn are connected to a number of stringers 54 (only one of which is shown) of the wing. In addition, the double plus-chord 30 includes upper and lower rightward extending flanges 56, 58 which form a channel 60 for receiving therein a number of paddle fittings 62 which in turn are joined to a number of stringers 64 for supporting the panels 42.

Once the wing is positioned as shown in FIGS. 1 and 2, vertical holes are drilled through the flanges 46, 48, 56 and 58 of the upper double plus-chord 30 as well as the flanges of the lower single phis-chord 34. In order to fasten the wing to the body, an assembly person climbs into the wing box and installs a bolt through each of the drilled holes (about 186 per wing on the Boeing 747) so that the threads are accessible above the exterior surfaces of the upper and lower wing skins. These bolts can have differing diameters.

At the same time, another assembly person on top of the wing, or beneath the wing, as the case may be, installs washers and nuts on these bolts and tightens the nuts by hand. These nuts are then tightened to about 70% of the required torque value using a conventional impact wrench.

Once this is accomplished, an assembly person with a large, "click-type", torque wrench begins tightening the nuts manually one at a time to a value which is a function of the nut size. At the same time, another assembly person inside the wing box engages the head of each bolt manually with a wrench to prevent it from mining as a result of the torque being applied by the person with the torque wrench. These assembly people, who are not in visual or hearing range, communicate with each other by tapping on the skin of the wing to simplify which bolt is being tightened as well as when the tightening process is to begin and then terminate.

This conventional process of tightening the nuts of the wing-to-body fasteners has several disadvantages. First, the high torque values which are required puts a severe physical strain on the person responsible for tightening the nuts. Second, injury can result to the person tightening the nuts if he happens to accidentally slip the torque wrench off of the nut during the tightening process. Third, the difficulty of communicating between the assembly outside of the wing box and the assembly person inside the wing box can be time consuming and inefficient. It is desirable therefore to provide apparatus and methods for tightening the fasteners which avoids the aforementioned problems of the conventional process.

Another conventional tightening tool and process was disclosed in U.S. Pat. No. 4,685,050 by Polzer et al which discusses a tool for automatically tightening fasteners to predetermined limit. However, this tool fails to avoid all of the aforementioned problems of tightening fasteners.

SUMMARY OF THE INVENTION

The present invention pertains to apparatus for assembling together a first part, such as a nut, and a second part, such as a bolt, of a first workpiece (fastener), and for assembling together a first part (nut) and a second part (bolt) of a second workpiece, such as another fastener. The apparatus includes first means, such as a socket, for engaging the first part of the first workpiece, and second means, such as another socket, for engaging the first part of the second workpiece.

In addition, there are means, such as a wrench, for manipulating the first part of the first workpiece relative to the second part of the first workpiece and for manipulating the first part of the second workpiece relative to the second part of the second workpiece. The manipulating means including means, such as a fitting, for grasping the first engaging means and the second engaging means.

Also, there are means, such as a socket tray, for storing the first engaging means when the first engaging means is not being grasped by the manipulating means and for storing the second engaging means when the second engaging means is not being grasped by the manipulating means. There are means for generating a first signal when the first engaging means is absent from the storing means and for generating a second signal when the second engaging means is absent from the storing means.

In addition, there is a controller for receiving the first signal and the second signal and for generating a first value in response to the first signal and a second value in response to the second signal, and for causing the manipulating means, in response to the first value, to manipulate the first engaging means and the first part of the first workpiece therewith a first amount relative to the second part of the first workpiece in order to assemble the first workpiece together, and for causing the manipulating means, in response to the second value, to manipulate the second engaging means and the first part of the second workpiece therewith a second amount relative to the second part of the second workpiece in order to assemble the second workpiece together.

In another embodiment, the apparatus also includes means, such as another wrench, for engaging the second part of the first workpiece when the first part of the first workpiece is being manipulated by the manipulating means. The second part engaging means including means for preventing the manipulating means from manipulating the first part of the first workpiece relative to the second part of the workpiece until the preventing means is operated.

BRIEF DESCRIPTION OF THE DRAWINGS

These and other details of the present invention will be discussed in greater detail in the following Detailed Description in connection with the attached drawings, in which:

FIG. 7 is a software flow chart describing the operation of a controller which forms part of the fastening machine;

DETAILED DESCRIPTION OF THE PREFERRED EMBODIMENT

Figure 1:
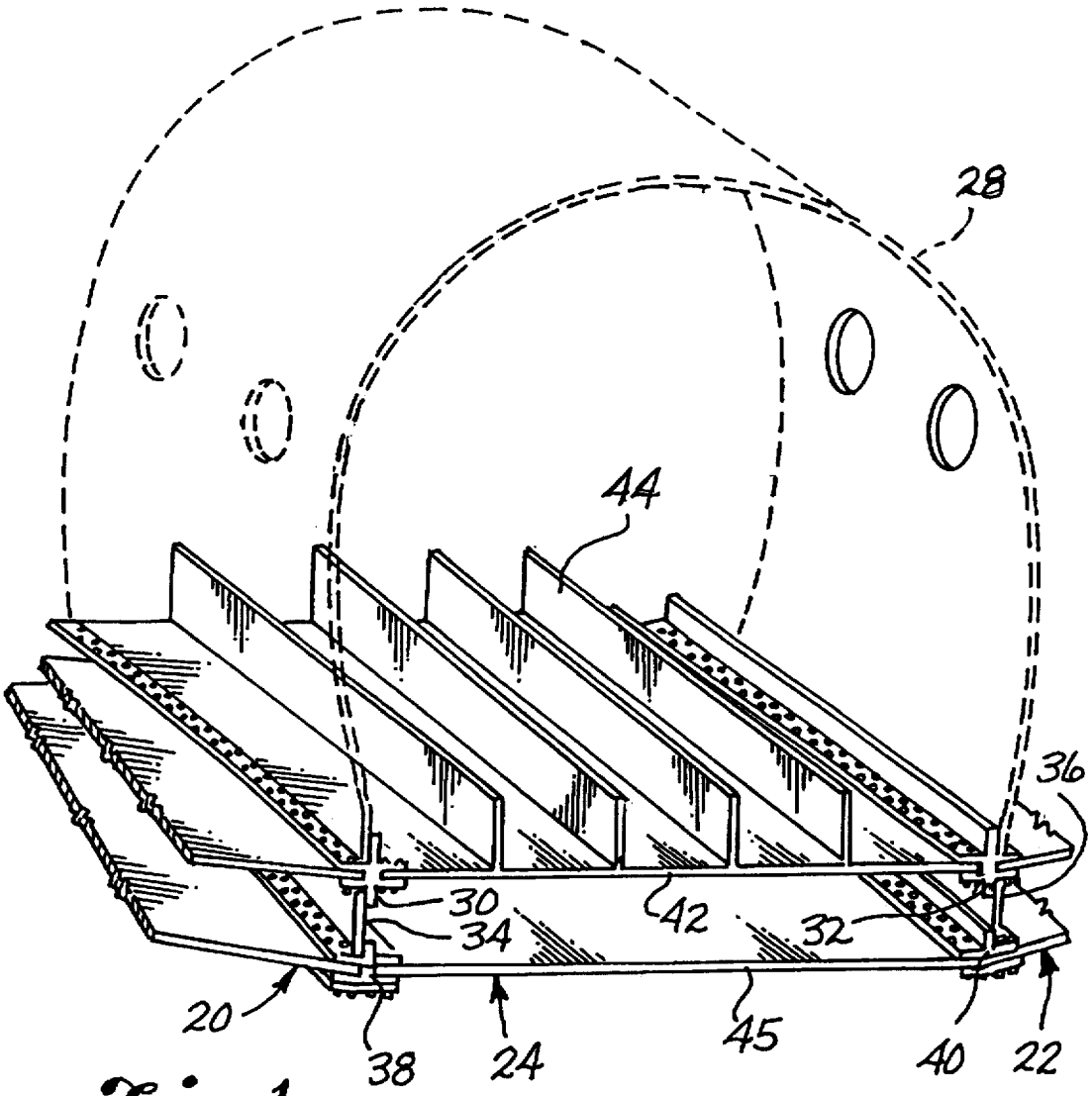
Fig 1 PRIOR ART
FIG. 1 is an isometric view showing the inboard ends of airplane port and starboard wing boxes joined to a center body section stub.
Figure 2:
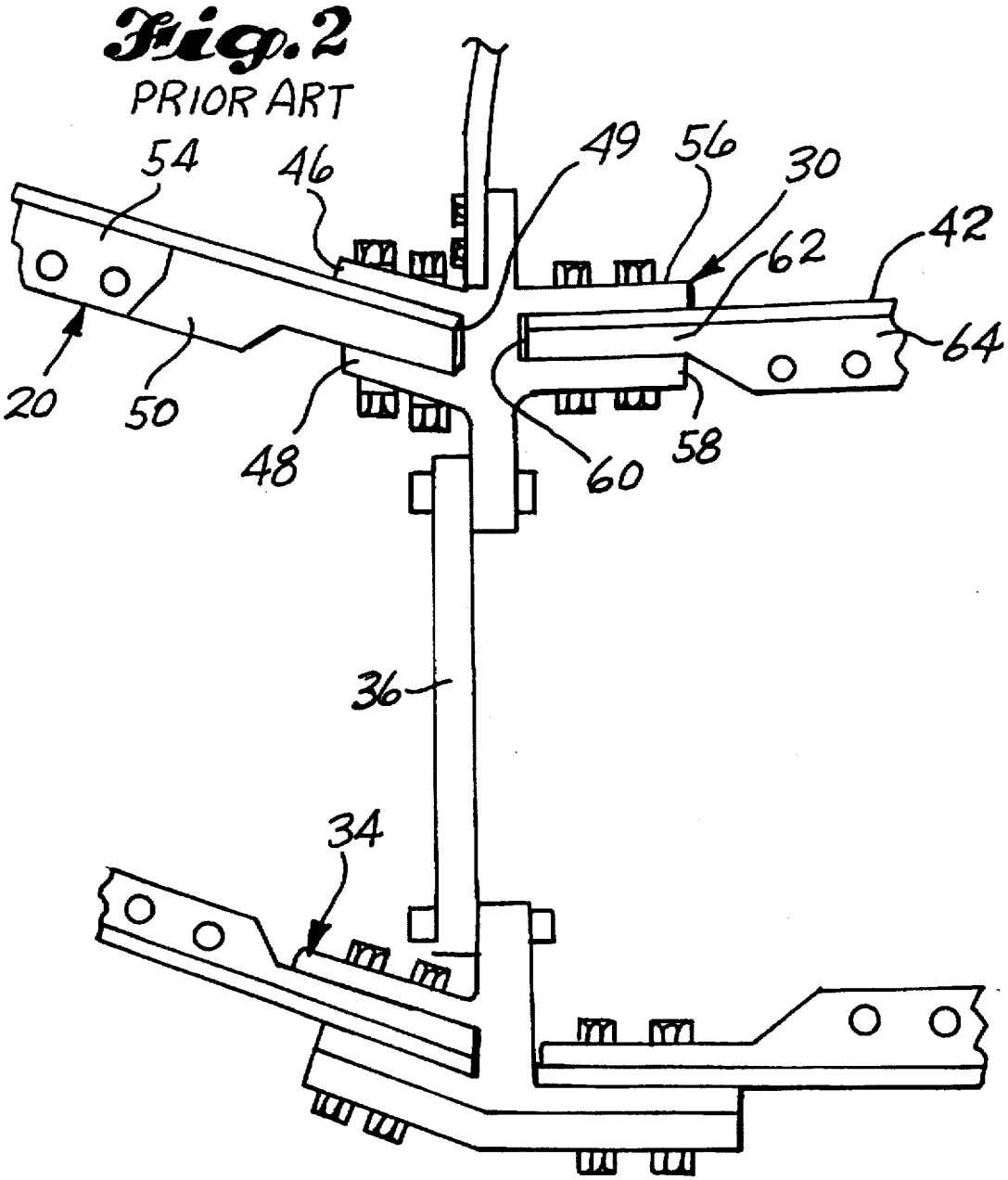
Fig. 2 PRIOR ART
FIG. 2 is a side view of an upper double plus-chord and a lower single plus-chord joined to the ends of a port wing box and center fuel tank panels.
Figure 3:
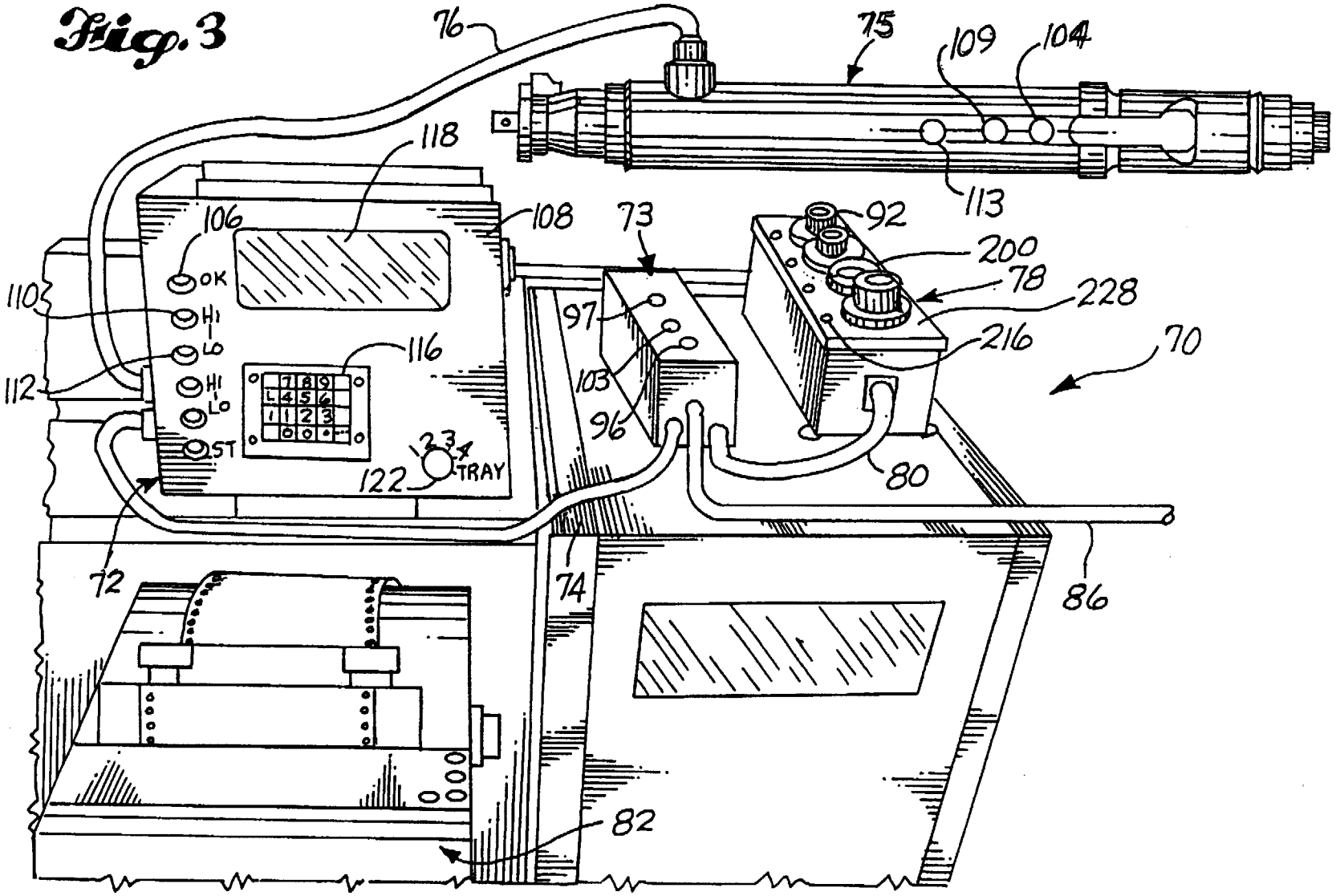
FIG. 3 is an isometric view of the fastening machine of the present invention.

Referring now to FIG. 3 there is shown the fastening machine, generally indicated at 70, of the present invention. The purpose of machine 70 is to tighten fasteners which are used to join the wings to the body of an airplane; the conventional method of accomplishing this task having been discussed earlier in the Background of the Invention. The machine 70 includes a controller indicated at 72 which is connected to a trigger switch box 73 by a wire bus 74, a nut tightening wrench (nut runner) indicated at 75 which is connected to the controller 72 by a wire bus 76, a socket tray indicated at 78 which is connected to the trigger switch box 73 by a wire bus 80, a conventional printer 82 which is connected to the controller 72 by a wire bus (not shown), and a bolt head holding wrench indicated at 84 (FIG. 5) which is connected to the trigger switch box 73 by a wire bus 86.

In the present fastening operation, four different diameters of bolts are used (although the system has the capability of handling additional different diameter bolts after slight modification). Furthermore, each diameter of bolt must be tightened to a different torque level.

Figure 4:
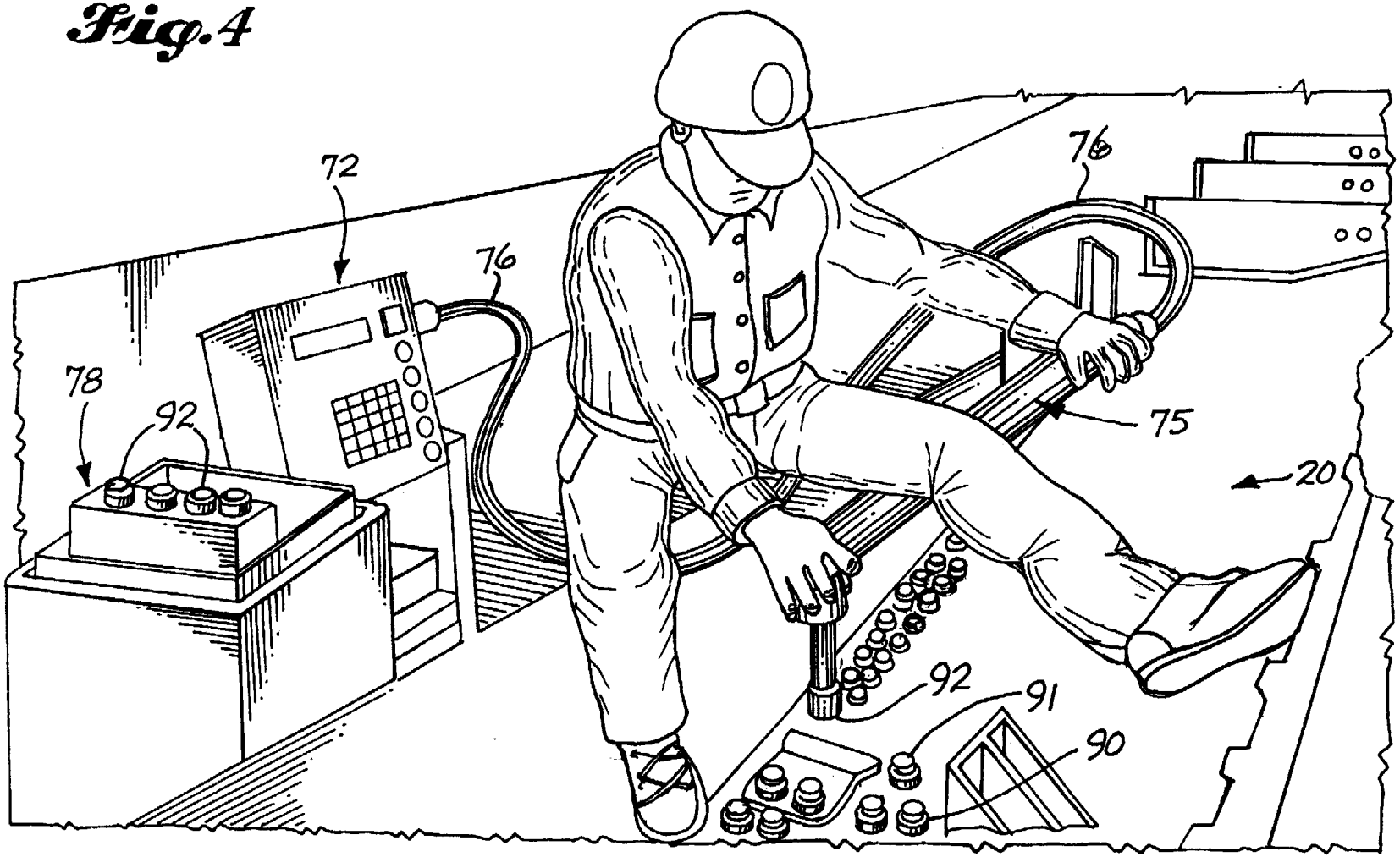
FIG. 4 is an isometric view showing use of the fastening machine of the present invention to tighten nuts for joining an airplane wing to the airplane body.
Figure 5:
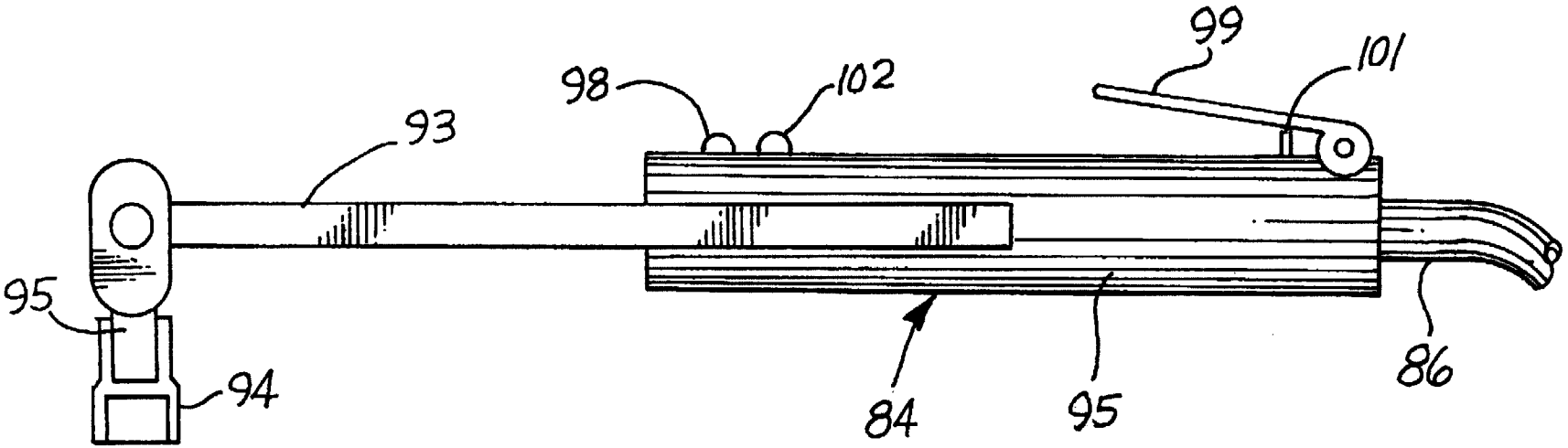
FIG. 5 is a side view of a holding wrench which forms part of the fastening machine.

Referring now to FIGS. 3 through 5, in order to tighten nuts 90 (FIG. 4) to the ends of threaded bolt shafts 91, the operator selects a socket 92 of the proper size from the socket tray 78. It should be appreciated that the wrench 75 shown in FIG. 4 has a conventional right angle drive whereas the wrench 75 shown in FIG. 3 has a conventional in line torque drive. The operator attaches the socket 92 to the end of the tightening wrench 75 and places it over the nut 90 to be tightened. At this time another operator (not shown) inside of the wing box places a socket head 94 of the holding wrench 84 (FIG. 5) over the proper bolt head to prevent this bolt from turning when the tightening wrench 75 begins to turn the nut 90. As shown in FIG. 5, the holding wrench 84 includes a breaker bar 93 having a socket fitting 95 at its left end for receiving the socket 94, and which has attached to its right end a handle housing 95.

Once this is done, the operator of the tightening wrench 75 (FIG. 3) depresses a switch 96 located on the trigger switch box 73 thereby completing an electrical circuit and sending a signal to the holding wrench 84 which turns on a "cycle on" light 97 also located on the trigger switch box 73. In addition, this turns on a "cycle on" light 98 on the holding wrench 84 thereby signaling the holding wrench operator to depress a safety lever 99 (which is pivotally connected at one end to the handle housing 95 of the holding wrench), thereby depressing a safety switch 101 located beneath the lever 99. The safety switch 101 is spring biased to the raised ("off" position) shown in FIG. 5.

In operation, when the holding wrench operator observes the "cycle on" light 97 illuminate, this operator depresses the safety lever 99 which (i) causes a "safety on" light 102 (FIG. 5) on the holding wrench handle to illuminate, (ii) causes a "safety on" light 103 on the trigger switch box 73 to illuminate, and (iii) closes an electrical circuit allowing power to go to the tightening wrench. This allows the tightening wrench 75 to begin mining the nut 90.

Tightening of the nut 90 proceeds until the proper torque is reached at which time the tightening wrench 75 automatically stops turning and a light 104 (FIG. 3) on the tightening wrench turns on indicating the proper torque has been reached. In addition, a light 106 on a front panel 108 of the controller 72 turns on indicating the proper torque has been reached. In the event the nut is over torqued, a light 110 on the controller front panel 108 and a light 109 on the tightening wrench turn on; whereas if the nut is under torqued, a light 112 on the controller front panel 108 and a light 113 on the tightening wrench 75 turn on.

During the tightening process if the operator of the holding wrench 84 should stop depressing the lever 99 (FIG. 5), power to the tightening wrench 75 is interrupted and the tightening process is terminated. In addition, the light 97 on the trigger switch box 73 turns off. In this manner, if the operator of the holding wrench, who is located inside the wing box and who can not be seen or heard by the operator of the tightening wrench, experiences difficulty and wishes to terminate the tightening process, he simply stops depressing the lever 99 of the holding wrench.

As shown in FIG. 3, the socket tray 78 includes four sockets 92 having the following sizes (in the present exemplary embodiment): ½ inch, 9/16 inch, ⅝ inch and ¾ inch to match the four sizes of nuts 90 which are used to join the wings to the body. Each of these four sizes of nuts must be tightened to a different torque value. That is, the ½ inch nut is torqued to a value of ninety foot pounds, the 9/16 nut is torqued to 135 foot-pounds; the ⅝ inch nut is torqued to 175 foot-pounds; and the ¾ inch nut is torqued to 316 foot-pounds. This is accomplished automatically in the present invention because when the operator removes the desired socket 92 from the socket tray 78, a signal is automatically sent from the socket tray 78 via the trigger switch box 73 to the controller 72 notifying the controller which socket was removed. The controller then determines the proper torque value associated with the removed socket, and automatically turns off the tightening wrench 75 when this target torque value is reached. To provide additional safety, in the event more than one socket 92 is missing from the socket tray 78, power to the tightening wrench 75 is interrupted.

Furthermore, as shown in FIG. 3, the controller 72 includes a key pad 116 for selecting torque parameter codes and values, as well as an alphanumeric display screen 118 for providing a visual readout of the target torque value for each nut and the actual torque value reached. In addition, this information is sent by the controller 72 to the printer 82 where it is printed out on paper. Operation of the controller 72 in this manner is achieved by turning a selector switch 122 to the "tray" position identified on the front panel 108 of the controller. If it is desired to bypass this function wherein the target torque is automatically selected as a function of the socket removed from the tray 78, then the switch 122 is moved to positions "1", "2", "3" or "4" instead. Operation of the controller in these positions is not part of the present invention.

In an exemplary embodiment, the controller 72 is a conventional monitor-controller for fabrication tools which combines an electronic motor controller with a microprocessor based torque monitor and controller. It is manufactured as Model CS 400 by Tech-Motive Tool of Farmington Hills, Mich.

Furthermore, in this exemplary embodiment, the tightening wrench 75 is a conventional DC torque wrench which includes an interface circuit card (not shown), a brushless DC motor 124 (FIG. 6), and a transducer strain gage 125. The interface circuit card incorporates two dynamic brake circuits for stopping the inertia of the motor upon reaching final torque. Preferably, the tightening wrench 75 is manufactured as Model LP-590 by Tech-Motive Tool.

Figure 6:
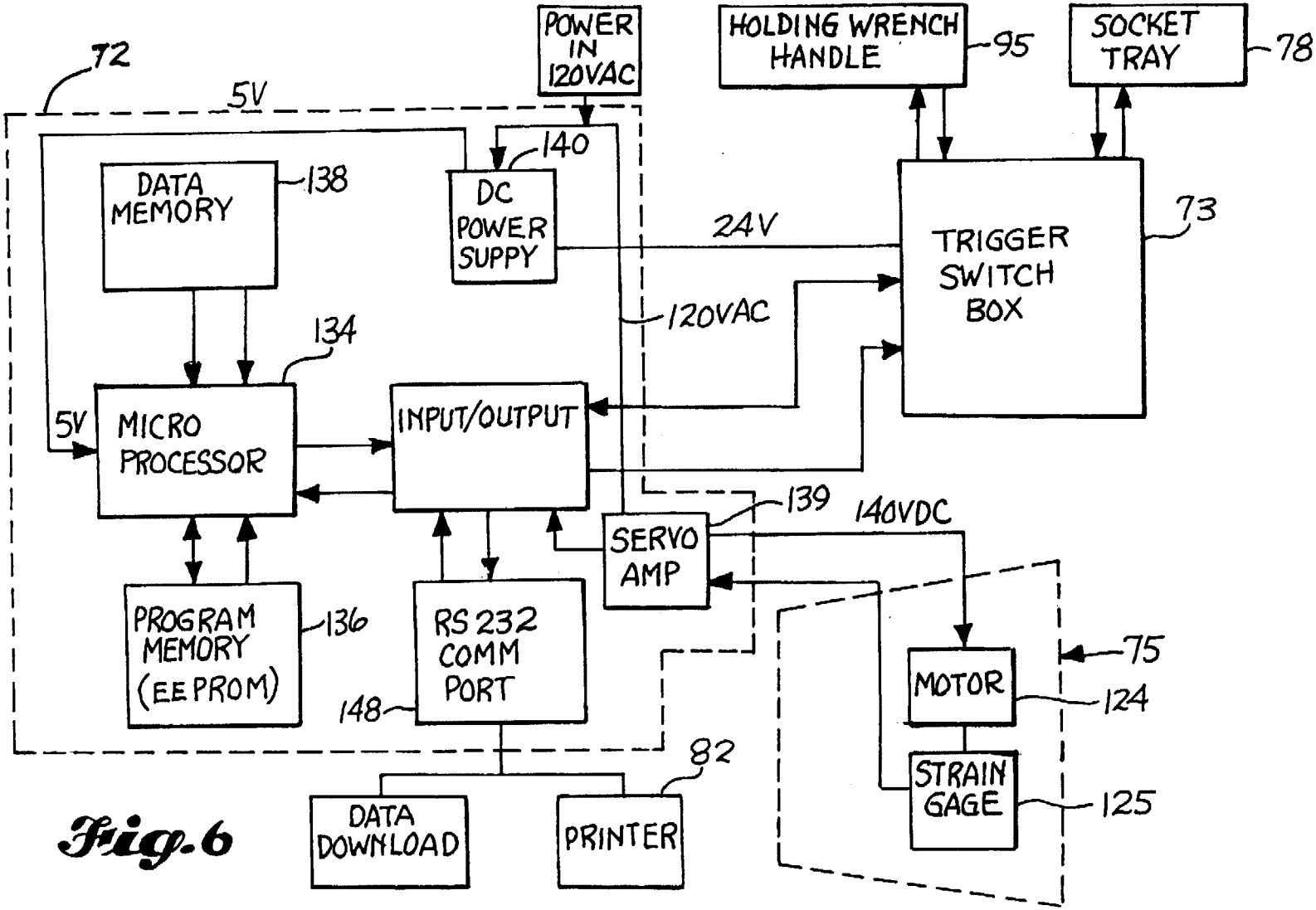
FIG. 6 is a box diagram showing some of the components of the fastening machine.

As further shown in FIG. 6, the controller 72 includes a conventional microprocessor 134 has a program memory 136 which stores the instructions for controlling operation of the controller. In addition, there is a conventional data memory 138 which stores, among other things, the torque and socket size parameters. Power to the controller 72 is provided by a standard 120 VAC source, and this input is fed to a servo amplifier/motor controller 139 of the controller. The servo amplifier 139 includes an AC to DC converter which transforms the 120VAC to 140VDC and feeds this to the motor 124 of the tightening wrench 75. In addition, the 120VAC input is converted by a conventional DC power supply 140 to a first value of 24VDC and a second value of 5VDC. The 5VDC power is sent to the microprocessor 134, whereas the 24VDC power is used for operation of the trigger switch box 73 and the holding wrench handle safety switch 101 and LEDs 98, 102.

In operation, when the tightening wrench switch 96 and the holding wrench safety lever 99 are depressed, respective signals are sent through the trigger switch box 73 to the controller 72 to initiate power to the tightening wrench motor 124 to been turning the nut 90. At the same time, the microprocessor 134 (FIG. 6) reads a signal from the socket tray 78 indicating which socket has been removed from the socket tray. The microprocessor 134 then obtains the correct torque value from the data memory 138 and provides this value to the servo amp 139 which compares the torque as measured by the strain gage 125 with the target torque and then terminates power to the tightening wrench motor 125 when these torque values are equal. Upon completion of this operation, the torque values are fed to an RS232 communications port 148 where they are available for downloading to another computer or for printing out by the printer 82.

As shown in FIG. 7, the controller 72, under the control of the program in program memory 136 (FIG. 6), first determines (at decision block 150) whether the "tray" position has been selected at the controller 72. If this is true, then the controller determines (at decision block 151) whether a single socket has been removed from the socket tray. If this is true, it determines which socket has been removed (at block 152). It does this by decoding a binary input from the socket tray switches which is unique to the socket removed. For example, if all sockets were present in the tray, the binary output would be 0000; whereas (i) if the smallest socket were removed the binary output would be 1000, (ii) the next larger socket removed would be 0100, (iii) the next larger socket removed would be 0010; and the largest socket removed would be 0001. If two sockets were removed from the tray at the same time, the binary output would have two "ones", e.g. 0101.

Having determined which socket was removed from the socket tray, the controller obtains the proper torque value from the data memory (block 154). It then determines whether (i) the tightening wrench lever has been depressed (decision block 156) and (ii) the holding wrench safety switch has been depressed (decision block 158). If these conditions are true, the tightening wrench begins turning the nut (block 160) until the target torque is reached (decision block 162) at which time the tightening wrench turns off (block 164) and the torque values are displayed (block 166). If the target torque is not reach within ten seconds after the tightening wrench motor starts, then a cycle timer (decision block 168) turns the wrench off. This is to provide additional safety in the event there is a problem during the tightening operation which, if proceeding correctly, should only take four or five seconds.

Figure 8:
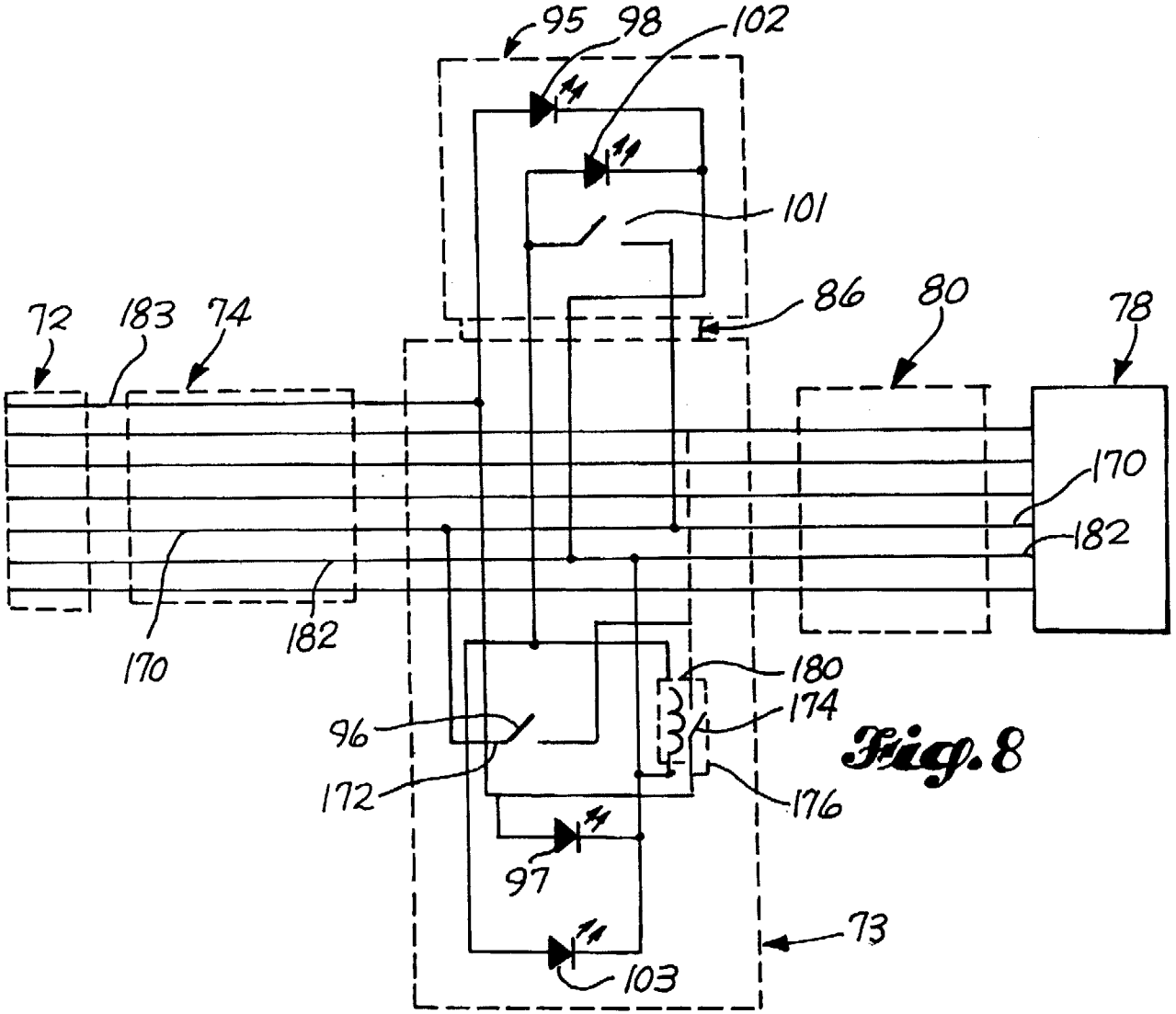
FIG. 8 is a circuit diagram which shows portions of a trigger box component and a safety handle component of the fastening machine.

Referring now to FIG. 8 there is shown the circuit diagrams for the tightening wrench trigger switch box 73 and the holding handle housing 95. In operation, a 24VDC input from the controller 72 at line 170 appears at an input 172 to the tightening wrench trigger switch 96. When the trigger switch 96 is closed, the 24V appears at the input to a switch 174 of the relay 176.

At the same time, when the safety switch 101 of the holding handle is closed, 24VDC from line 170 appears (i) across a coil 180 of the relay 176 and then feeds back through a DC common line 182 and (ii) at the "safety on" LED 102 (illuminating the LED 102) on the holding handle and back to DC common (line 182) and (iii) at the "safety on" LED 103 (illuminating the LED 103) on the trigger switch box 73 and back to DC common (line 182). The 24V across the coil 180 causes the relay switch 174 to close which sends the 24V (i) through a "cycle on" input 183 of the controller 72, (ii) through the "cycle on" LED 98 on the holding handle (illuminating the LED 98) and back to DC common (line 182), and (iii) through the "cycle on" LED 97 located on the trigger switch box 73 (illuminating the LED 97) and back to DC common (line 182).

The "cycle on" signal to the controller 72 indicates that both the safety switch 101 and the trigger switch 96 are closed, thereby causing the controller 72 to send power to the tightening wrench motor as discussed previously.

Figure 9:
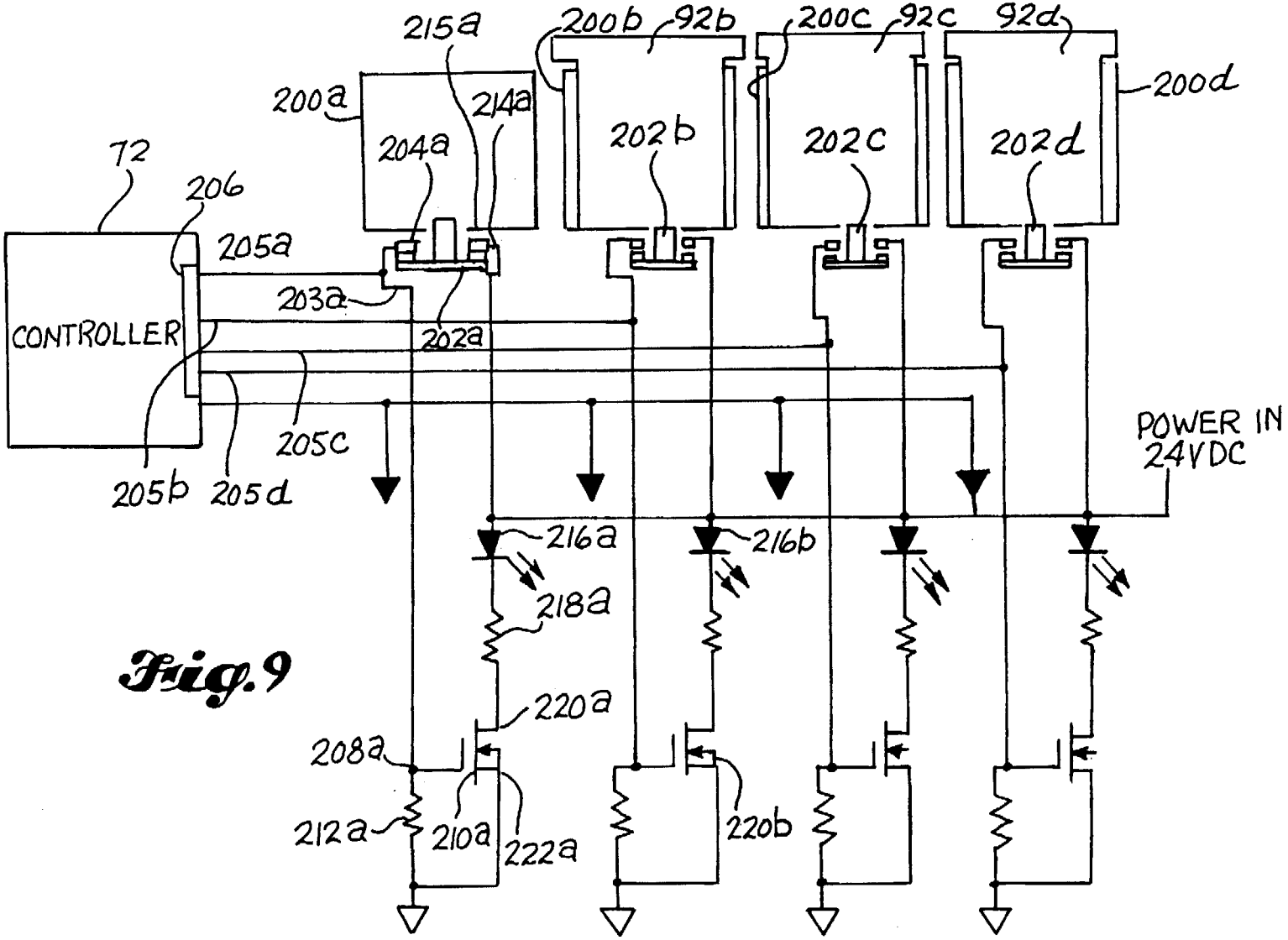
FIG. 9 is a circuit diagram showing a portion of the socket tray component of the fastening machine.

Referring now to FIG. 9, the socket tray 78 includes four socket holders 200*a,b,c,d*. It should be noted that common elements are denoted by the same number with a letter suffix added. In an exemplary embodiment, the smallest socket is stored in socket holder 200*a*, the next larger socket in 200*b*, and so forth. As shown in FIG. 9, sockets 92*b,c,d* are sitting in socket holders 200*b,c,d*; whereas socket holder 200*a* is empty indicating that the smallest socket is being used. Located at the bottom of each socket holder 200 is a conventional, normally closed, single pole, push button activated switch 202. When switch 202 is closed, its left moving contact 203 is connected through a stationary terminal 204 (i) to an input 205 of a decoder 206 of the controller 72 and (ii) to the gate 208 of a transistor 210 which in turn is tied through a resistor 212 to ground. In addition, when switch 202 is closed, its right moving contact 214 is connected through a stationary terminal 215 to an LED 216 which in turn is tied through a current limiting resistor 218 to a drain 220 of the transistor 210 which has its source 222 tied to ground. In addition, the 24VDC input from the power supply 140 is connected between the LED 216 and stationary terminal 215.

In operation, when a socket (e.g. **92*b*) is in the respective socket holder 200*b*, the normally closed switch 202*b* is moved to the open position. In the present embodiment, placement of the socket 92*b* in the socket holder 200*b* depresses a vertical tab portion 226*b* of the switch located at the bottom of the socket holder, which causes switch 202*b* to move to the "open" position. This causes the transistor 210*b* to turn off thereby mining off the LED 216*b* indicating a socket is present in that socket holder. In addition, the input 205*b* to decoder 206** is pulled low (digital "0").

On the other hand, when a socket 92 (e.g. **92*a*) is removed from the socket holder 200*a*, switch 202*a* is spring biased to the closed position thereby causing transistor 210*a* to turn on which in turn causes LED 216*a* to turn on indicating a socket has been removed from the tray. At the same time, the respective input 205*a* to decoder 206 goes high (digital "1"). As discussed earlier, based upon the inputs 205, the decoder 206 provides a signal to the microprocessor notifying it which socket holder 200 is empty and by inference, which socket 92 has been removed from the socket tray 78. Since this socket 92 will only fit one sized nut having a unique torque value for that size, this correspondence is stored in the data memory 138 (FIG. 6) of the controller and is used as the target torque value to control operation of the tightening wrench 75** for that particular size nut.

The LED status lights 216 provide the tightening wrench operator with a visual indication of which socket or sockets have been removed from the tray. These lights 216 (FIG. 3) are located on a top cover plate 228 of the socket tray 78 adjacent to the respective socket holder 200.

What is claimed is:

1. Apparatus for assembling together first and second parts of a first workpiece and for assembling together first and second parts of a second workpiece, the apparatus comprising:

a. first means for engaging the first part of the first workpiece;

b. second means for engaging the first part of the second workpiece;

c. means for manipulating the first part of the first workpiece relative to the second part of the first workpiece and for manipulating the first part of the second workpiece relative to the second part of the second workpiece, the manipulating means including means for grasping the first engaging means and the second engaging means;

d. means for storing the first engaging means when the first engaging means is not being gasped by the manipulating means and for storing the second engaging means when the second engaging means is not being grasped by the manipulating means;

e. means for generating a first signal when the first engaging means is absent from the storing means and for generating a second signal when the second engaging means is absent from the storing means; and f. a controller for receiving the first signal and the second signal and for generating a first value in response to the first signal and a second value in response to the second signal, and for causing the manipulating means, in response to the first value, to manipulate the first engaging means and the first part of the first workpiece therewith a first mount relative to the second part of the first workpiece in order to assemble the first workpiece together, and for causing the manipulating means, in response to the second value, to manipulate the second engaging means and the first part of the second workpiece therewith a second amount relative to the second part of the second workpiece in order to assemble the second workpiece together.

2. The apparatus as set forth in claim 1 wherein:

a. the first engaging means is stored in a first location of the storing means and the second engaging means is stored in a second location of the storing means; and b. the controller includes means for detecting when the first engaging means is absent from the first location and for generating the first signal in response to such absence from the first location, and for detecting when the second engaging means is absent from the second location and for generating the second signal in response to such absence from the second location.

3. The apparatus as set forth in claim 2 wherein:

a. the first part of the first workpiece is a first nut and the first part of the second workpiece is a second nut; and b. the first engaging means is a first socket for engaging the first nut and the second engaging means is a second socket for engaging the second nut.

4. The apparatus as set forth in claim 3 wherein the storing means is a socket tray for storing the first socket at the first location and for storing the second socket at the second location.

5. The apparatus as set forth in claim 4 wherein:

a. the manipulating means is a wrench having a fitting for attaching the first socket and the second socket thereto; and b. the wrench, in response to the first value, operates to cause the first socket to rotate the first nut, when the first socket is engaged to the first nut, the first amount so as to assemble the first nut to the first workpiece.

6. The apparatus as set forth in claim 5 wherein:

a. the second part of the first workpiece is a first bolt and the second part of the second workpiece is a second bolt; and b. the first workpiece is a first fastener and the second workpiece is a second fastener.

7. The apparatus as set forth in claim 1 additionally comprising means for engaging the second part of the first workpiece when the first part of the first workpiece is being manipulated by the manipulating means, the second part engaging means including means for preventing the manipulating means from manipulating the first part of the first workpiece relative to the second part of the workpiece until the preventing means is operated.

8. The apparatus as set forth in claim 7 wherein the manipulating means includes a handle to allow a first human operator to operate the manipulating means.

9. The apparatus as set forth in claim 8 wherein:

a. the second part engaging means includes a handle to allow the second part engaging means to be operated by a second human operator; and b. the preventing means is a switch which is operated by moving the switch from a first position to a second position.

10. A method for assembling a first nut and a first bolt together and a second nut and a second bolt together, the method comprising the following steps:

a. removing a first socket from a storing mechanism;

b. attaching the first socket to a wrench;

c. grasping the first nut with the first socket;

d. removing the first socket from the wrench and placing the first socket in the storing mechanism;

e. removing a second socket from the storing mechanism, the second socket having a different size than the first socket;

f. attaching the second socket to the wrench;

g. grasping the second nut with the second socket;

h. generating a first signal when the first socket is not in the storing mechanism and a second signal when the second socket is not in the storing mechanism;

i. generating a first value in response to the first signal and a second value in response to the second signal; and j. causing the wrench to turn the first socket a first amount in response to the first value in order to assemble the first nut onto the first bolt, and causing the wrench to the turn the second socket a second amount in response to the second value in order to assemble the second nut onto the second bolt.

* * * * *